US008028680B2

(12) United States Patent
Park

(10) Patent No.: US 8,028,680 B2
(45) Date of Patent: Oct. 4, 2011

(54) FUEL SYSTEM FOR LIQUEFIED PETROLEUM INJECTION ENGINE

(75) Inventor: Jung Soo Park, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 857 days.

(21) Appl. No.: 12/029,859

(22) Filed: Feb. 12, 2008

(65) Prior Publication Data

US 2009/0151705 A1 Jun. 18, 2009

(30) Foreign Application Priority Data

Dec. 14, 2007 (KR) ..... 10-2007-0131600

(51) Int. Cl.
*F02M 37/00* (2006.01)

(52) U.S. Cl. ..... 123/514; 123/525; 96/212; 96/236; 96/237; 96/238

(58) Field of Classification Search ..... 123/514, 123/519, 520, 515, 518, 525, 526; 96/163, 96/167, 188, 212, 236, 237, 238
See application file for complete search history.

(56) References Cited

U.S. PATENT DOCUMENTS 4,860,714 A * 8/1989 Bucci ..... 123/514
4,869,225 A * 9/1989 Nagata et al. ..... 123/509
4,893,647 A * 1/1990 Tuckey ..... 137/493
5,050,567 A * 9/1991 Suzuki ..... 123/514
5,080,077 A * 1/1992 Sawert et al. ..... 123/514
5,111,844 A * 5/1992 Emmert et al. ..... 137/565.33
5,139,000 A * 8/1992 Sawert ..... 123/514
5,146,901 A * 9/1992 Jones ..... 123/516
5,218,942 A * 6/1993 Coha et al. ..... 123/514
5,341,842 A * 8/1994 Chih et al. ..... 137/574
5,368,001 A * 11/1994 Roche ..... 123/510
5,456,235 A * 10/1995 Porter ..... 123/509
5,579,740 A * 12/1996 Cotton et al. ..... 123/516
5,809,975 A * 9/1998 Tuckey et al. ..... 123/509
6,457,945 B2 * 10/2002 Kleppner et al. ..... 417/84
6,619,272 B2 * 9/2003 Jones et al. ..... 123/514

FOREIGN PATENT DOCUMENTS

KR 10-2007-0020729 A 2/2007

* cited by examiner

*Primary Examiner* — Thomas Moulis
*Assistant Examiner* — Raza Najmuddin
(74) *Attorney, Agent, or Firm* — Morgan, Lewis & Bockius LLP

(57) ABSTRACT

A fuel system for an LPI engine according to an exemplary embodiment of the present invention may include a reservoir disposed in a fuel tank, a recovery pipe inserted in the reservoir, and a fuel pump disposed in the reservoir and supplying LPI fuel, wherein liquefied fuel mixed with gaseous fuel recovered through the recovery pipe is separated in the reservoir and the liquefied fuel is pumped again by the fuel pump.

8 Claims, 5 Drawing Sheets

FUEL SYSTEM FOR LIQUEFIED PETROLEUM INJECTION ENGINE

CROSS-REFERENCE TO RELATED APPLICATION

This application claims priority to and the benefit of Korean Patent Application No. 10-2007-0131600 filed in the Korean Intellectual Property Office on Dec. 14, 2007, the entire contents of which are incorporated herein by reference.

BACKGROUND OF THE INVENTION (a) Field of the Invention

The present invention relates to a fuel system for a liquefied petroleum injection (LPI) engine, and more particularly to a fuel system for an LPI engine integrally provided with a fuel pump such that the fuel system has less components and manufacturing cost of the fuel system is reduced.

(b) Description of the Related Art

An LPI engine has high power and low emission of pollutants, and alleviates problems of conventional liquefied petroleum gas (LPG) engines such as environmental pollution, low power, and low quality.

An LPI engine injects high pressure liquefied fuel with an injector. That is, a fuel pump is mounted in a fuel tank and supplies fuel to the injector through a fuel line.

Power performance of an LPI engine is substantially the same as a gasoline engine, and fuel consumption and acceleration performance of an LPI engine is good. In addition, startability of an LPI engine is remarkably enhanced.

A supply pipe is mounted between the fuel pump and the injector, and a recovery pipe is mounted between the injector and the fuel tank. Fuel remaining in a combustion process in an engine is recovered to the fuel tank through the recovery pipe. A return valve (check valve) is mounted at the recovery pipe.

According to a conventional fuel system for an LPI engine, noise may occur at the return valve when mixture of liquefied and gaseous fuel is recovered.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a fuel system for an LPI engine having advantages of reducing noise when liquefied and gaseous fuel is recovered.

In addition, the present invention has been made in an effort to provide a fuel system for an LPI engine having further advantages that fuel recovered to a fuel tank is easily supplied to an engine.

A fuel system for an LPI engine according to an exemplary embodiment of the present invention may include: a recovery pipe wherein liquefied fuel mixed with gaseous fuel is recovered therethrough; a reservoir wherein an end portion of the recovery pipe is inserted therein and separates the liquefied fuel from the mixture of the liquefied fuel and the gaseous fuel; a supply pipe wherein an end portion the supply pipe is positioned in the reservoir; and a fuel pump disposed in the reservoir and supplying LPI fuel while the liquefied fuel separated from the mixture of the liquefied fuel and the gaseous fuel is pumped back through the supply pipe by the fuel pump.

The fuel system may further comprise a cover including a first recovery hole and a supply holes wherein the cover substantially encloses an upper portion of the reservoir and the end portion of the recovery pipe is configured to be connected with the reservoir through the first recovery hole and the end portion of the supply pipe is configured to be connected to the fuel pump through the supply hole.

The cover of the fuel system may include at least a gas hole on the cover to release gas.

The first recovery hole of the fuel system may be configured to include a gap between an inner circumference of the first recovery hole and the recovery pipe sufficiently enough to release the gas and/or the supply hole is configured to include a gap between an inner circumference of the supply hole and the supply pipe sufficiently enough to release the gas.

The fuel system of the present invention as an exemplary embodiment may include a first pathway formed in a longitudinal direction of the reservoir from a lower portion of the reservoir, and the liquefied fuel mixed with the gaseous fuel is moved upwardly through the first pathway.

The first pathway may be formed by a partition and a portion of the interior surface of the reservoir along the longitudinal direction of the reservoir.

The fuel system of the present invention as an exemplary embodiment may include a second pathway is connected between the end portion of the recovery pipe and a lower portion of the first pathway, and positioned at the lower portion of the reservoir.

The end portion of the recovery pipe and one end of the second pathway may be connected by a connector opened toward an tipper direction to receive the end portion of the recovery pipe.

The fuel system of the present invention as an exemplary embodiment may include a reservoir cup mounted in the reservoir, wherein a lower surface of the reservoir cup is spaced with a predetermined height from the lower portion of the reservoir by a retainer of the reservoir cup and provided with a groove corresponding to the first pathway and a second recovery hole through which the recovery pipe passes.

The liquefied fuel mixed with the gaseous fuel may be spouted upwardly over the reservoir cup through the first pathway, and thereby the liquefied fuel is separated from the mixture of the liquefied fuel and the gaseous fuel by weight.

The reservoir cup may further include a rim wherein the rim supports the reservoir cup against the reservoir and prevents the liquefied fuel separated from the mixture from overflowing the lower surface of the reservoir cup.

The rim of the reservoir cup may be positioned under or the same level of top portion of the first pathway and configured to be positioned substantially at a center of the reservoir cup and at least a mounting bracket having at least an inlet hole is formed at a upper portion of the retainer to mount the fuel pump and collect through the inlet hole the liquefied fuel separated from the mixture.

As an exemplary embodiment of the present invention, the LPI fuel sucked through a suction hole may be pumped to the supply pipe and a part of the LPI fuel sucked through the suction hole may be merged into the liquefied fuel mixed with the gaseous fuel in the second pathway.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
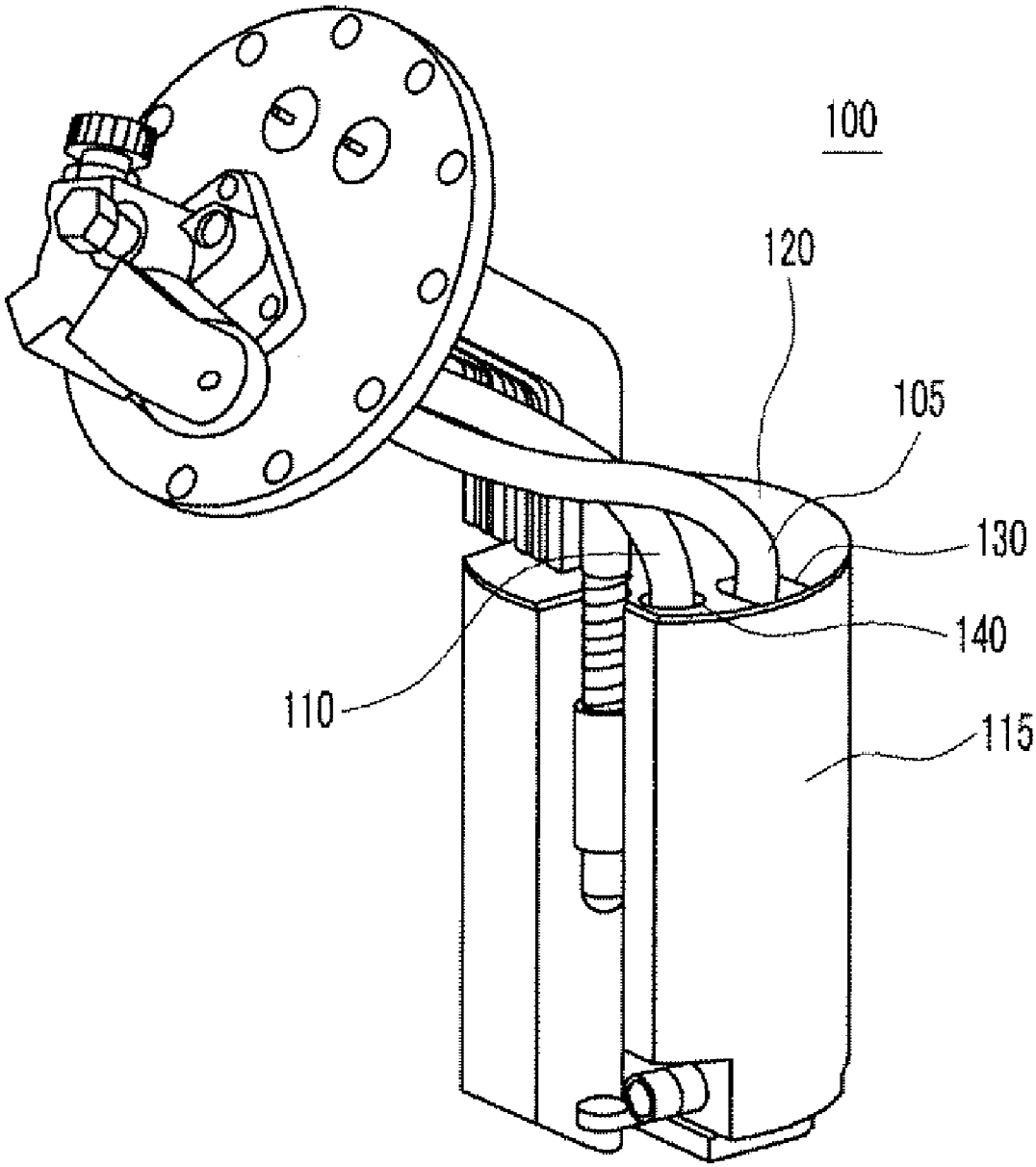
FIG. 1 is a perspective view of a fuel system for an LPI engine according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations and shapes will be determined in part by the particular intended application and use environment.

In the figures, reference numbers refer to the same or equivalent parts of the present invention throughout the several figures of the drawing.

| <Description of Reference Numerals Indicating Primary Elements in the Drawings> | |
|---|---|
| 100: | fuel system |
| 105: | recovery pipe |
| 110: | supply pipe |
| 115: | reservoir |
| 120: | cover |
| 130: | first recovery hole |
| 140: | supply hole |
| 205: | reservoir cup |
| 210: | second recovery hole |
| 215, 215a, 215b: | partition |
| 220: | first pathway |
| 225: | mounting bracket |
| 230: | lower surface |
| 250: | rim |
| 260: | mounting hole |
| 263: | retainer |
| 265: | inlet hole |
| 300: | groove |
| 400: | connector |
| 405: | second pathway |
| 500: | recovered fuel |
| 505: | sucked fuel |
| 520: | suction hole |

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, referring to the accompanying drawings, a fuel system for an LPI engine according to an exemplary embodiment of the present invention will be described in detail.

FIG. 1 is a perspective view of a fuel system for an LPI engine according to an exemplary embodiment of the present invention.

As shown in FIG. 1, a fuel system 100 for an LPI engine includes a supply pipe 110, a recovery pipe 105, a reservoir 115 and a cover 120. A first recovery hole 130 and a supply hole 140 is configured to receive supply and recovery pipes 105 and 110 respectively and through the first recovery hole 130, the recovery pipe 105 is inserted into the reservoir 115 and through the supply hole 140, the supply pipe 110 is inserted into the reservoir 115.

A fuel pump (referring to FIG. 5) is mounted in the reservoir 115.

According to the present exemplary embodiment, the fuel pump may be a brush-type motor or a brushless DC motor.

The brush-type motor has a simple structure and is inexpensive, but has drawbacks such as occurrence of cavitations and low durability.

The brushless DC motor has a long life, but has a complex structure and is expensive. The fuel pump mounted in the reservoir is well known to a person skilled in the art so a detailed description will be omitted.

Figure 2:
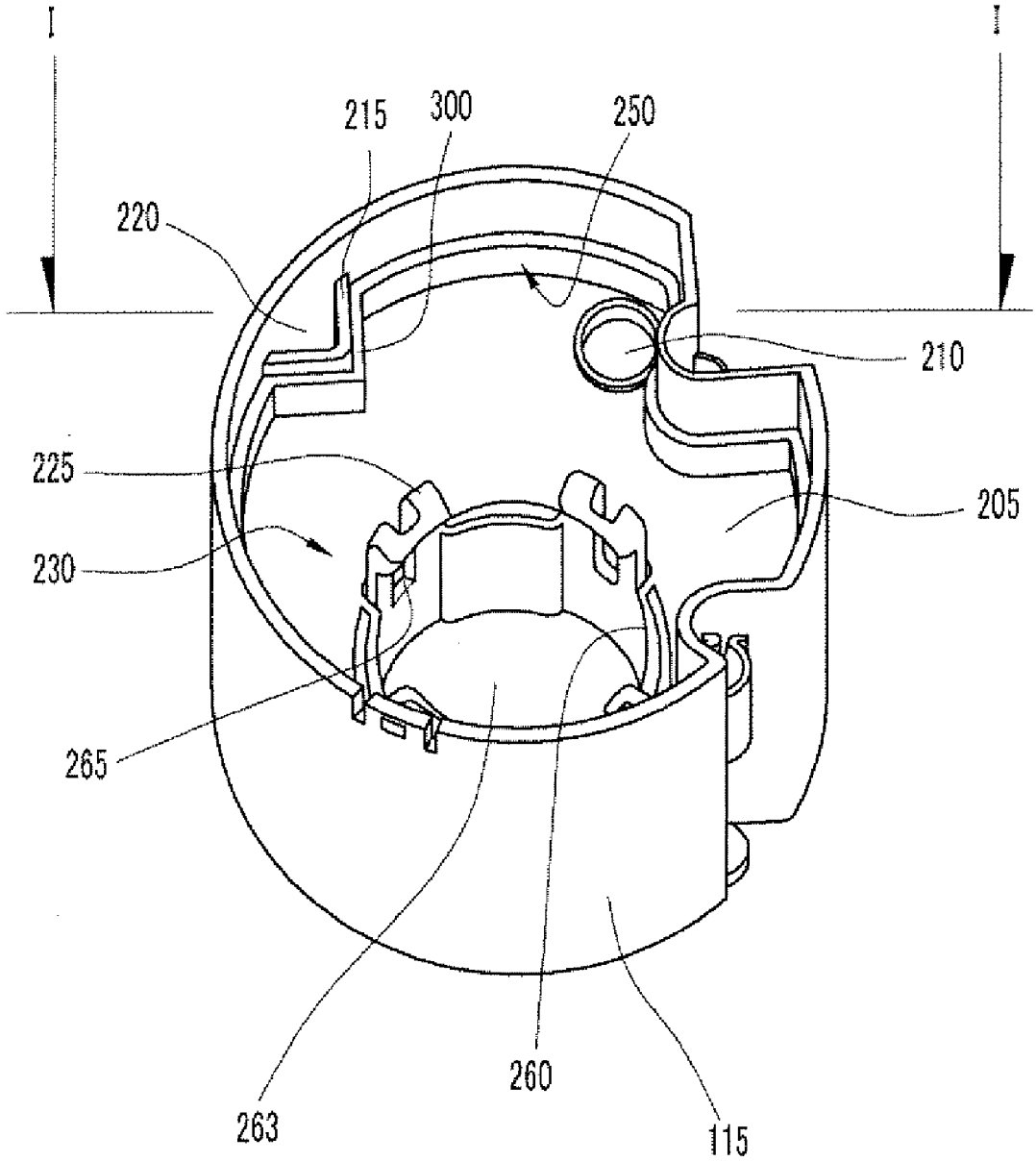
FIG. 2 is an exploded perspective view of a fuel system of an LPI engine according to an exemplary embodiment of the present invention.

FIG. 2 is an exploded perspective view of a fuel system of an LPI engine according to an exemplary embodiment of the present invention.

As shown in FIG. 2, the fuel system 100 includes the reservoir 115 and a reservoir cup 205.

The reservoir cup 205 is mounted in the reservoir 115. The reservoir cup 205 comprises a rim 250, a retainer 263, a second recovery hole 210, a groove 300 and a lower surface 230. The retainer 263 comprises one-side opened mounting hole 260 formed at an upper portion of the retainer 263 and positioned substantially at a center portion of the power surface 230 of the reservoir cup 205. The lower surface 230 of the reservoir cup 205 is spaced from a lower portion of the reservoir 115 with a predetermined height by the retainer 263.

The fuel pump (referring to FIG. 5) is mounted in the retainer 263 and receives liquefied fuel separated from a mixture of the liquefied fuel and gaseous fuel as explained later in detail.

A partition 215 is formed at a portion of an interior surface of the reservoir 115 and complimentarily supported by the groove 300 of the reservoir cup 205.

In addition, the second recovery hole 210 is formed at a portion of the lower surface 230 of the reservoir cup 205 and the recovery pipe 105 is configured to be inserted into the second recovery hole 210 of the reservoir cup 205 after the recovery pipe 105 passes through the first recovery hole 130 formed at the cover 120. Therefore, the mixture of liquefied and gaseous fuel recovered through the recovery pipe 105 is moved to a lower portion of the reservoir 115.

The mixture of liquefied and gaseous fuel moved to the lower portion of the reservoir 115 is flown through a second pathway 405 positioned at the lower portion of the reservoir 115 and spouted upwardly through a first pathway 220 formed by the partition 215.

Figure 3:
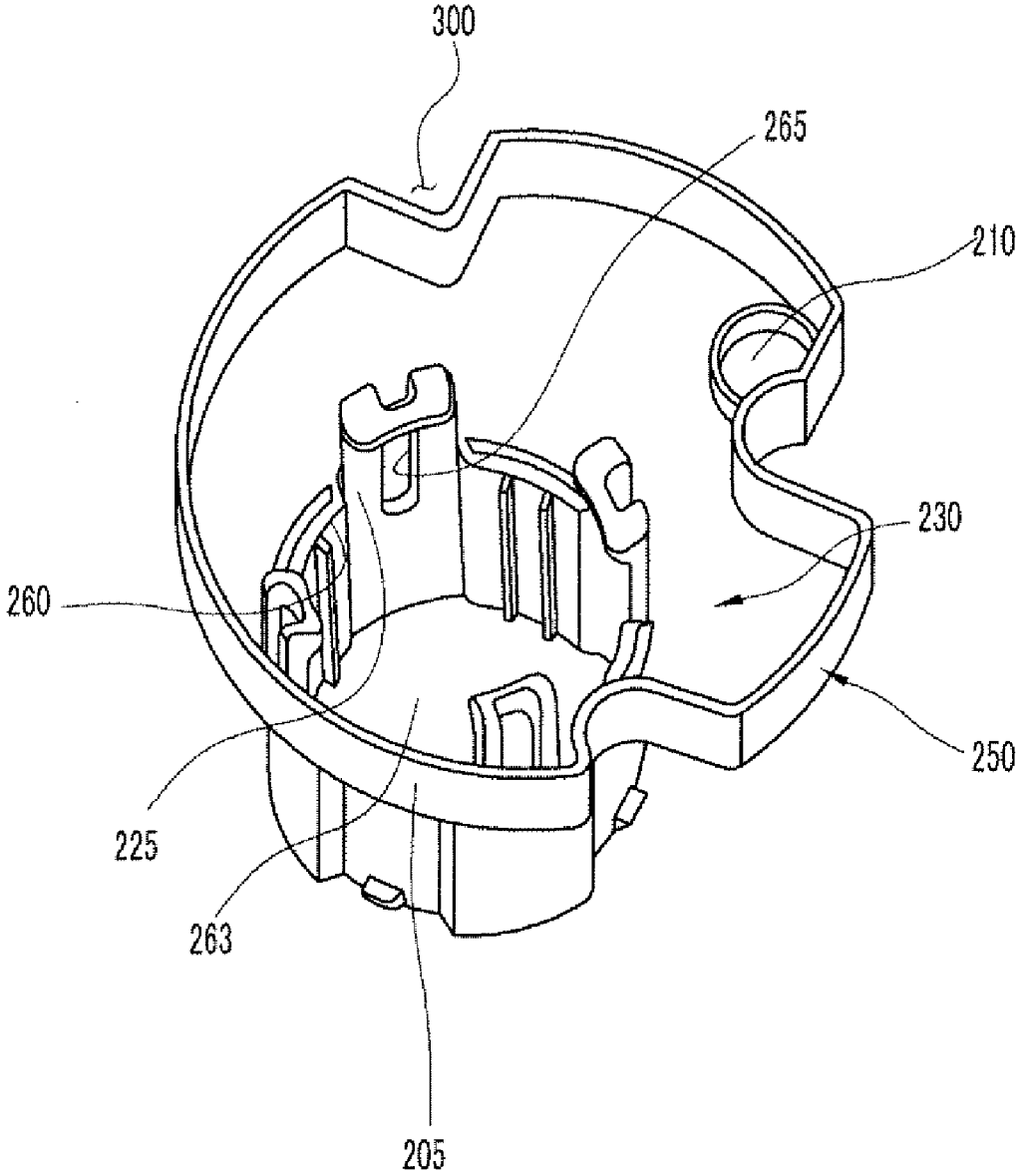
FIG. 3 is a perspective view of a reservoir cup according to an exemplary embodiment of the present invention.

FIG. 3 is a perspective view of a reservoir cup according to an exemplary embodiment of the present invention.

As shown in FIG. 3, the second recovery hole 210, the groove 300, and the retainer 263 are formed at the reservoir cup 205 as explained above.

The second recovery hole 210 is formed at the lower surface 230 of the reservoir cup 205, and the groove 300 has a shape corresponding to the partition 215 formed at the interior surface of the reservoir 115.

Figure 4:
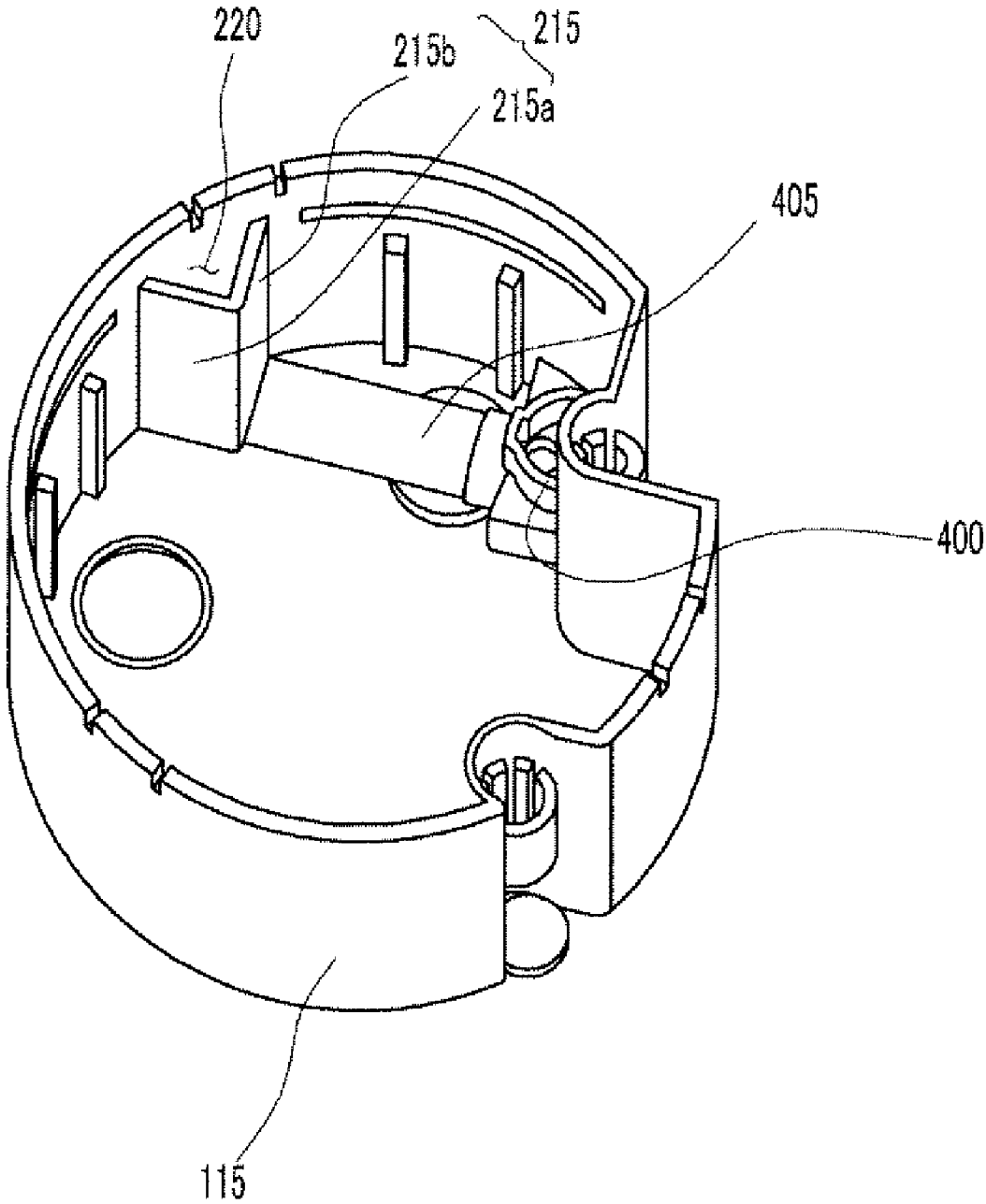
FIG. 4 is a perspective view of a reservoir according to an exemplary embodiment of the present invention.

FIG. 4 is a perspective view of a reservoir according to an exemplary embodiment of the present invention.

As shown in FIG. 4, a connector 400, a second pathway 405 and the partition 215 are formed at a lower portion of the reservoir 115.

The connector 400 connects one distal end portion of the recovery pipe 105 and one end of the second pathway 405. The other end of the second pathway 405 is connected with a distal end portion of the first pathway 220. The mixture of liquefied and gaseous fuel recovered through the recovery pipe 105 passes through the second pathway 405 into the first pathway 220.

The partition 215 comprises a first partition 215*a* and a second partition 215*b* forced at an interior surface of the reservoir 115 and the first pathway 220 is configured to be enclosed by a portion of the interior surface of the reservoir 115, the first partition 215*a*, and the second partition 215*b*.

The mixture of liquefied and gaseous fuel recovered through the recovery pipe 105 passing through the second pathway 405 is spouted upwardly through the first pathway 220.

Once the mixture of liquefied and gaseous fuel is spouted upwardly through the first pathway 220, the liquefied fuel is separated from the mixture of the liquefied fuel and gaseous fuel by gravity. Then, the separated liquefied fuel flows over the rim 250 of the reservoir cup 205. Accordingly, the rim 250 of the reservoir cup 205 functions as preventing the separated liquefied fuel from overflowing the reservoir cup 205, reserving the liquefied fuel until flowing into the retainer 263 of the reservoir cup 205 to make the flown liquefied fuel stable and thus reduces occurrence of cavitations in the separated liquefied fuel.

The liquefied fuel reserved temporarily on the lower surface 230 of the reservoir cup 205 flows into the retainer 263 through at least an inlet hole 265 formed at mounting brackets 225 as show in FIG. 3. The mounting brackets 225 are formed along a circumference of a mounting hole 260 positioned on a upper portion of the retainer 263.

The gas separated from the mixture may be released through the first recovery hole 130 and the supply hole 140 of the cover 120. In another embodiment of the present invention, the cover 120 may have at least a gas hole (not shown) to release the gas more effectively.

Particularly, according to the present exemplary embodiment, noise occurring in separating the liquefied fuel from the mixture of the liquefied fuel and gaseous fuel may be reduced while the recovered fuel passes through the recovery pipe 105, the connector 400, the second pathway 405, and the first pathway 220. Furthermore, as shown in FIG. 1, since the cover 120 covers an upper portion of the reservoir 115, noise may further reduced.

Figure 5:
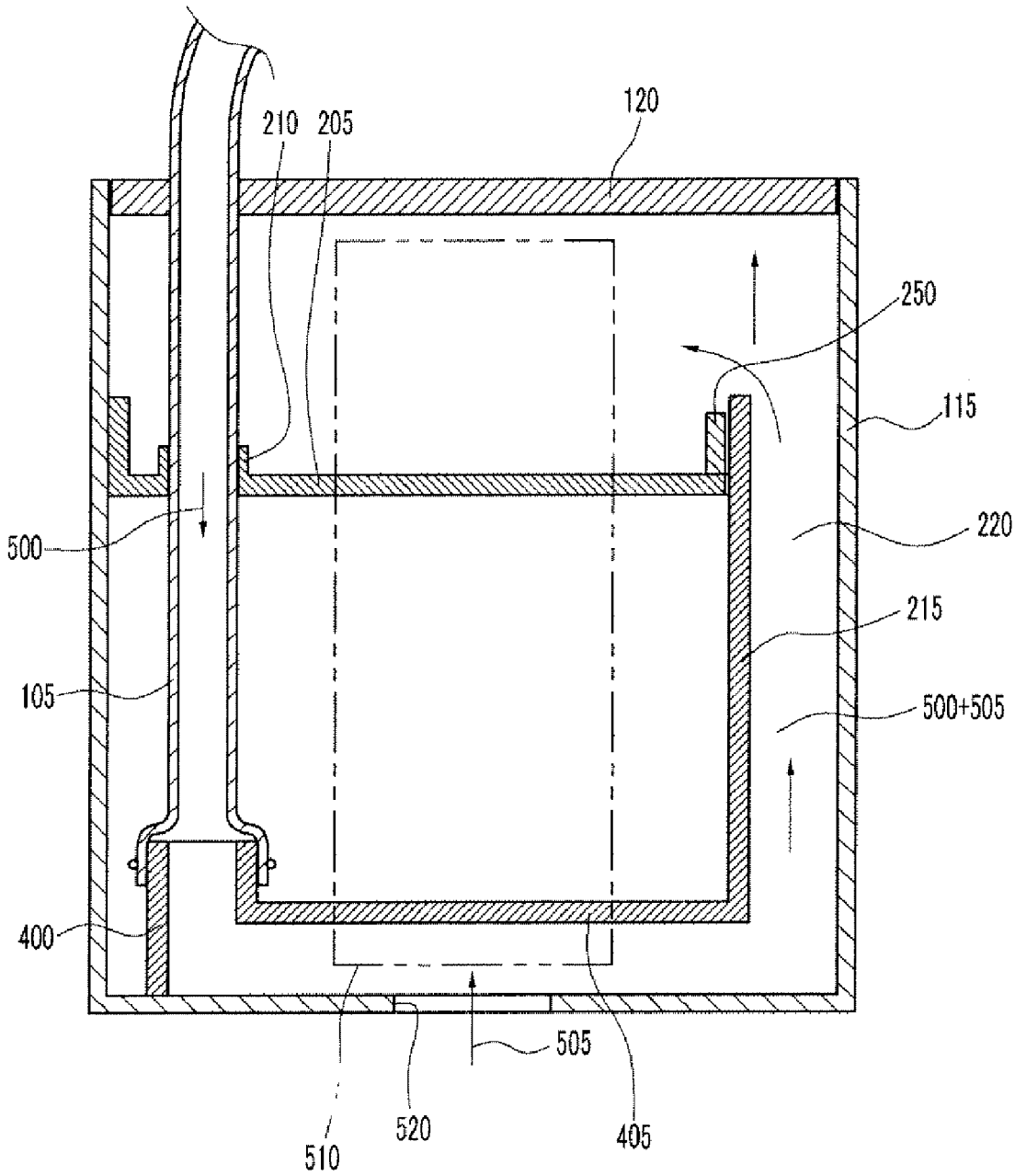
FIG. 5 is a cross-sectional view taken along a line I-I of FIG. 2

FIG. 5 is a cross-sectional view taken along a line I-I of FIG. 2.

As shown in FIG. 5, the recovery pipe 105 penetrates the cover 120 through a first recovery hole 130 (shown in FIG. 1) and the reservoir cup 205 through the second recovery hole 210 (shown in FIG.3), and is connected to the connector 400 positioned at the lower portion of the reservoir 115.

In an embodiment of the present invention, a sucked LPI fuel 505 sucked through a suction hole 520 is moved to the fuel pump 510 through a passageway (not shown) positioned at the lower portion of the reservoir 115. Then the sucked LPI fuel 505 is supplied to the injector by the fuel pump 510 through the supply pipe 110.

In another embodiment of the present invention, a part of the sucked LPI fuel 505 sucked through the inlet hole 520 may be bifurcated to the second pathway 405 to join the recovered fuel 500 already moved downwardly through the recovery pipe 105, and then spouted upwardly through the first pathway 220 formed by the partition 215 as explained above.

The mixture of liquefied and gaseous fuel is moved to a space between the lower surface 230 of the reservoir cup 205 and the cover 120 through the first pathway 220. The liquefied fuel is separated by gravity force from the mixture of the liquefied fuel and gaseous fuel at the space.

As described above, since one end of the recovery pipe is mounted in a reservoir enclosed by a cover, noise may be easily reduced according to an exemplary embodiment of the present invention.

In addition, since a separator that separates liquefied fuel from the mixture of the liquefied fuel and gaseous fuel is integrally formed with the fuel pump, assembly efficiency of a fuel system may be improved and volume of the fuel system may be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A fuel system for a liquefied petroleum injection (LPI) engine, comprising:

a recovery pipe, wherein liquefied fuel mixed with gaseous fuel is recovered therethrough;

a reservoir, wherein an end portion of the recovery pipe is inserted therein and separates the liquefied fuel from the mixture of the liquefied fuel and the gaseous fuel;

a supply pipe, wherein an end portion of the supply pipe is positioned in the reservoir; and a fuel pump disposed in the reservoir and supplying LPI fuel while the liquefied fuel separated from the mixture of the liquefied fuel and the gaseous fuel is pumped back through the supply pipe by the fuel pump;

wherein a first pathway is formed in a longitudinal direction of the reservoir from a lower portion of the reservoir, and the liquefied fuel mixed with the gaseous fuel is moved upwardly through the first pathway, the first pathway being formed by a partition and a portion of an interior surface of the reservoir along the longitudinal direction of the reservoir;

wherein a second pathway is connected between the end portion of the recovery pipe and a lower portion of the first pathway, and positioned in the lower portion of the reservoir; and wherein the end portion of the recovery pipe and one end of the second pathway is connected by a connector opened toward an upper direction to receive the end portion of the recovery pipe; and a reservoir cup mounted in the reservoir; and wherein a lower surface of the reservoir cup is spaced with a predetermined height from a bottom surface of the reservoir by a retainer of the reservoir cup to separate the reservoir into the lower portion and an upper portion thereof and provided with a groove corresponding to the first pathway and a second recovery hole through which the recovery pipe passes;

wherein the lower surface of the reservoir cup disposed in the upper portion of the reservoir communicates with the second pathway through the first pathway; and wherein the liquefied fuel mixed with the gaseous fuel is spouted upwardly over the reservoir cup through the first pathway, and thereby the liquefied fuel is separated from the mixture of the liquefied fuel and the gaseous fuel by weight; and a cover including a first recovery hole and a supply hole;

wherein the cover substantially encloses an upper portion of the reservoir and the end portion of the recovery pipe is configured to be connected with the reservoir through the first recovery hole and the end portion of the supply pipe is configured to be connected to the fuel pump through the supply hole; and wherein the cover includes at least a gas hole on the cover to release gas.

2. The fuel system of claim 1, wherein the first recovery hole is configured to include a gap between an inner circumference of the first recovery hole and the recovery pipe sufficiently enough to release the gas and/or the supply hole is configured to include a gap between an inner circumference of the supply hole and the supply pipe sufficiently enough to release the gas.

3. The fuel system of claim 2, wherein the cover includes at least a gas hole on the cover to release the gas.

4. The fuel system of claim 1, wherein the reservoir cup further includes a rim wherein the rim supports the reservoir cup against the reservoir and prevents the liquefied fuel separated from the mixture from overflowing the lower surface of the reservoir cup.

5. The fuel system of claim 4, wherein the rim of the reservoir cup is positioned under or the same level of top portion of the first pathway.

6. The fuel system of claim 1, wherein the retainer of the reservoir cup is configured to be positioned substantially at a center of the reservoir cup and at least a mounting bracket having at least an inlet hole is formed at a upper portion of the retainer to mount the fuel pump and collect through the inlet hole the liquefied fuel separated from the mixture.

7. The fuel system of claim 6, wherein the LPI fuel sucked through a suction hole is pumped to the supply pipe.

8. The fuel system of claim 7, wherein a part of the LPI fuel sucked through the suction hole is merged into the liquefied fuel mixed with the gaseous fuel in the second pathway.

* * * * *